US006362415B1

(12) United States Patent
Snyder et al.

(10) Patent No.: US 6,362,415 B1
(45) Date of Patent: Mar. 26, 2002

(54) HV CONNECTOR WITH HEAT TRANSFER DEVICE FOR X-RAY TUBE

(75) Inventors: Douglas J. Snyder, Brookfield; Liang Tang, Waukesha, both of WI (US)

(73) Assignee: General Electric Company, Waukesha, WI (US)

( * ) Notice: Subject to any disclaimer, the term of this patent is extended or adjusted under 35 U.S.C. 154(b) by 0 days.

(21) Appl. No.: 09/565,982

(22) Filed: May 4, 2000

(51) Int. Cl.[7] ..... H01B 9/06; H01J 1/02

(52) U.S. Cl. ..... 174/15.1; 174/74 R; 174/15.2; 313/32

(58) Field of Search ..... 174/74 R, 74 A, 174/76, 84 R, 77, 15.2, 15.1; 313/318, 22, 30, 32

(56) References Cited

U.S. PATENT DOCUMENTS 3,719,847 A * 3/1973 Webster ..... 313/60
3,735,175 A * 5/1973 Blomgren, Jr. ..... 313/60
3,982,059 A * 9/1976 Holland et al. ..... 174/73 R
4,165,472 A * 8/1979 Wittry ..... 313/35
4,335,928 A * 6/1982 Barrett et al. ..... 339/94 C
5,056,126 A * 10/1991 Klostermann et al. ..... 378/127
5,303,283 A * 4/1994 Jedlitschka et al. ..... 378/202
5,420,906 A * 5/1995 Smit et al. ..... 378/141
5,442,131 A * 8/1995 Borgwarth ..... 174/15.6
5,596,621 A * 1/1997 Schwarz et al. ..... 378/130
5,682,412 A * 10/1997 Skillicorn et al. ..... 378/98.6
6,018,565 A * 1/2000 Ergun et al. ..... 378/95
6,076,595 A * 6/2000 Austin et al. ..... 165/104.26
6,097,789 A * 8/2000 Mueller ..... 378/130
6,134,300 A * 10/2000 Trebes et al. ..... 378/136
6,160,868 A * 12/2000 Snyder et al. ..... 378/127

* cited by examiner

*Primary Examiner*—Dean A. Reichard
*Assistant Examiner*—William H. Mayo, III
(74) *Attorney, Agent, or Firm*—Jenkens & Gilchrist

(57) ABSTRACT

Apparatus for connecting an HV cable to the cathode of an X-ray tube is provided with a housing disposed for attachment to the X-ray tube, and a quantity of epoxy or other electric insulating material contained within the housing. The epoxy serves to insulate the exposed end portions of the HV cable conductors, which extend beyond the cable insulation for insertion into the X-ray tube casing. The connector apparatus further includes a heat transfer device, such as a heat pipe, which extends long the cable within the connector housing. A quantity of working fluid contained in the heat transfer device is disposed for bi-directional movement along the device to transfer heat from a first location within the insulating material to a second location proximate to the housing.

20 Claims, 4 Drawing Sheets

HV CONNECTOR WITH HEAT TRANSFER DEVICE FOR X-RAY TUBE

BACKGROUND OF THE INVENTION

The invention disclosed and claimed herein generally pertains to improved apparatus for connecting a high voltage (HV) electric cable to an X-ray tube. More particularly, the invention pertains to apparatus of the above type which effectively transfers heat through the connector apparatus, so that heat generated in the X-ray tube is not trapped in a region proximate to the connector. Even more particularly, the invention pertains to apparatus of the above type which employs an elongated heat transfer device, such as a heat pipe or the like, to enhance heat dissipation with respect to the connector apparatus.

In a rotating anode X-ray tube, a beam of electrons is directed through a vacuum and across very high voltage, on the order of 100 kilovolts, from a cathode to a focal spot position on an anode. X-rays are produced as electrons strike the anode, comprising a tungsten target track, which is rotated at high speed. However, the conversion efficiency of X-ray tubes is quite low, typically less than 1% of the total power input. The remainder, in excess of 99% of the input electron beam power, is converted to thermal energy or heat. Accordingly, heat removal, or other effective procedure for managing heat, tends to be a major concern in X-ray tube design.

In a common arrangement, an HV electric power cable is employed to provide the requisite 100 kilovolt potential difference between the cathode and anode, in order to produce X-rays as stated above. One end of the cable is connected to a power source of sufficiently high voltage, and the other end is connected into the tube, for connection to the cathode, by means of an HV connector assembly. The connector assembly generally comprises structure for holding the end of the cable in place with respect to the tube, so that the end portion of the cable conductors, which may comprise either a single conductor or a number of conductors, can be joined to a tube. Accordingly, the connector assembly further comprises a quantity of HV insulation placed to surround any exposed portion of the cable conductors which lie outside the tube. The HV insulation is joined to the X-ray tube and is comparatively thick, in view of the high voltage of the cable conductors.

Generally, good high voltage insulating materials, such as epoxy, also tend to be very poor thermal conductors. This can create a very undesirable situation, if an HV connector assembly of the prior art is directly attached to an X-ray tube, such as across an end thereof. As stated above, a great deal of heat is generated in the X-ray tube, as an undesired byproduct of X-ray production. Some of this heat is directed against the connector insulation material, which has a comparatively large area in contact with the tube. Because of its poor thermal conductive properties, this insulator serves as a heat barrier, so that a substantial amount of heat tends to accumulate proximate to the connector. As a result, the temperature limits of the connector insulation may be readily exceeded, so that the steady state performance of the X-ray tube must be limited.

In one previous arrangement for dealing with this constraint, a reservoir of cooling oil is placed between the HV connector and structure inserted into the tube to support the cathode. However, this arrangement requires that the oil serve as a dielectric. In another arrangement, cooling oil is circulated through the HV connector. This arrangement, however, requires a completely separate oil circuit, provided with tubing and a circulation pump. Thus, this approach can significantly increase cost. In a third prior art arrangement, a good thermal conductor is placed in the electrical insulation of the HV connector to enhance heat flow. However, such thermal conductors can compromise or degrade dielectric characteristics, and have tended to diminish the electrical insulating capabilities of the HV connector assembly.

SUMMARY OF THE INVENTION

The invention provides apparatus for connecting a high voltage electric cable to an X-ray tube, wherein the apparatus may be attached directly to the tube, such as to the outer surface of the tube casing. The apparatus effectively insulates any exposed portions of the HV cable conductors, and at the same time readily dissipates heat from regions proximate or adjacent to the connector apparatus. The apparatus generally comprises a housing joined to the X-ray tube, and a quantity of selected electric insulating material contained within the housing, the insulating material being traversed by a portion of the HV cable. The apparatus further comprises an elongated heat transfer device positioned within the insulating material to extend along the traversing portion of the cable, in closely spaced relationship therewith. A quantity of selected working fluid is sealably contained in the heat transfer device, the working fluid being disposed for bidirectional movement along the device to transfer heat from a first location within the insulating material to a second location which is proximate to or outside of the housing. By placing the heat transfer device along the cable, and more particularly along the electric conductors thereof, the transfer device does not cut across voltage potential lines, and therefore will not interfere with the electrical insulating requirements of the HV connector.

Preferably, the heat transfer device comprises a conduit segment of selected length, the conduit segment having an inner wall in adjacent relationship with a sealed interior space. A selected porous material is attached to the inner wall and configured to define a passage through the sealed interior space that extends along the length of the conduit segment, the porous material being selected in relation to the working fluid so that the fluid, when in liquid form, is disposed for movement through the porous material by means of capillary action. When the first location is at a selectively higher temperature than the second location, fluid proximate to the first location is vaporized into gaseous form, moved along the passage by means of convection to the second location, and then condensed into liquid form.

In one useful embodiment, the conduit segment is placed or positioned with respect to the cable so that the electrical conductors of the cable extend through the center of the conduit segment, along the axis thereof. The conduit segment comprises a selected electrically conductive material. A sleeve, likewise formed of electrically conductive material, is positioned within the conduit segment, in coaxial relationship therewith, between the sealed interior space and the conductors of the cable.

In a second useful embodiment, the apparatus is provided with a sleeve of selected electrically conductive material which is placed around the cable conductors. The conduit segment comprises one of a plurality of substantially identical conduit segments which are positioned around the outer surface of the sleeve, in abutting relationship therewith and equally spaced apart from one another.

DETAILED DESCRIPTION OF THE PREFERRED EMBODIMENT

Figure 1:
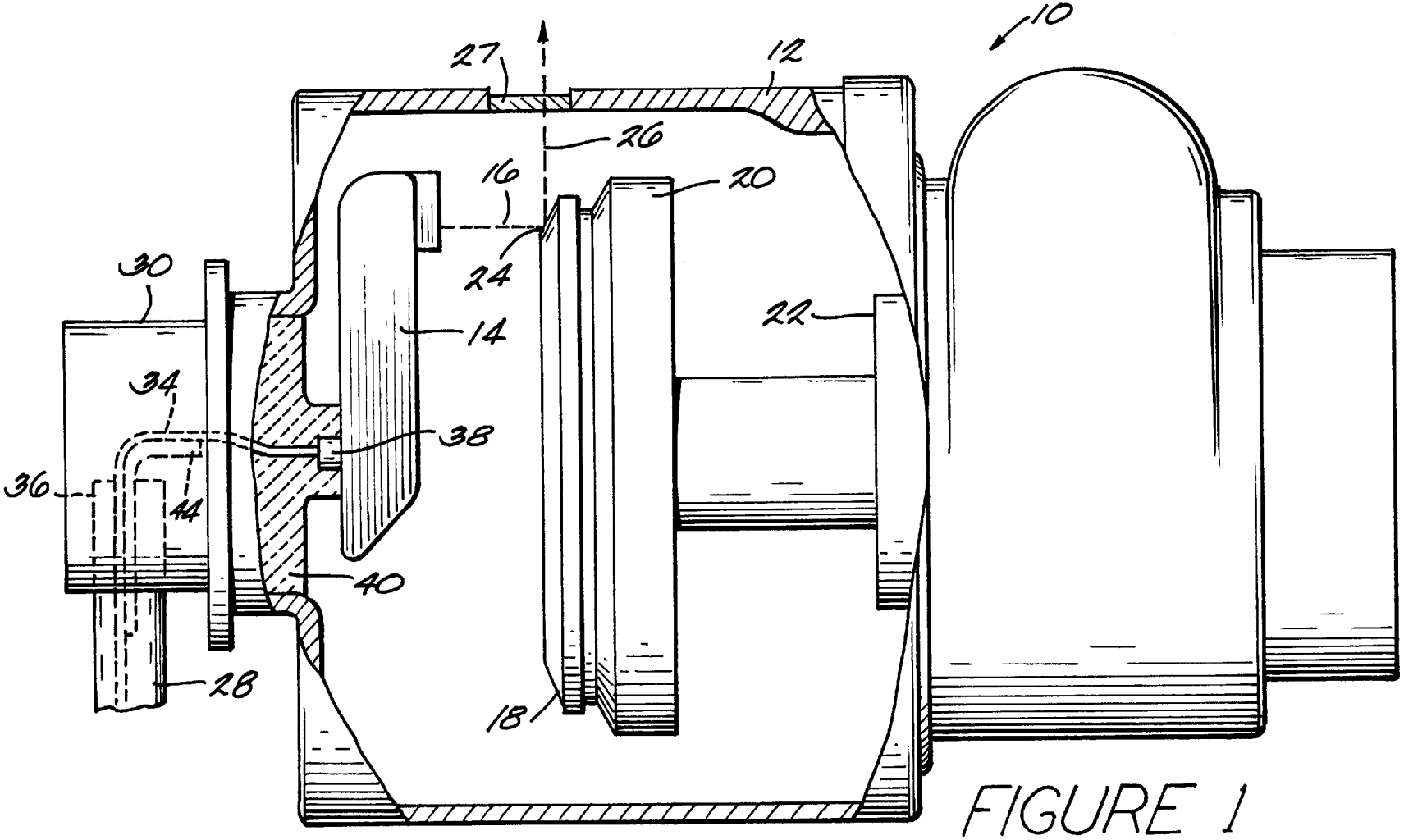
FIG. 1 is a perspective view with a section broken away, showing an X-ray tube provided with a simplified embodiment of the invention.

Referring to FIG. 1, there is shown an X-ray tube 10. In accordance with conventional practice, tube 10 generally includes a metal housing 12 which supports other X-ray tube components including a cathode 14, and also provides a protective vacuum enclosure therefor. Cathode 14 directs a high energy beam of electrons 16 onto a target track 18 of an anode 20, which consists of a refractory metal disk and is continually rotated by means of a conventional mounting and drive mechanism 22. Target track 18 has an annular or ring-shaped configuration and typically comprises a tungsten based alloy integrally bonded to the anode disk 20. As anode 20 rotates, the electron beam from cathode 14 impinges upon a continually changing portion of target track 18 to generate X-rays, at a focal spot position 24. A beam of X-rays 26 generated thereby is projected from the anode focal spot through an X-ray transmissive window 27 provided in the side of housing 12.

In order to produce X-rays as described above, there must be a potential difference on the order of 100 kilovolts between cathode 14 and anode 20. In a monopolar tube arrangement this is achieved by connecting the anode to a ground (not shown), and applying power at the required 100 kilovolt range to cathode 14 through an electric cable 28. Because of the high voltage carried by cable 28, it is necessary to use an HV connector 30 in coupling the cable to cathode 14. The connector 30 and its interconnection with cable 28 is shown in greater detail in FIG. 2.

Figure 2:
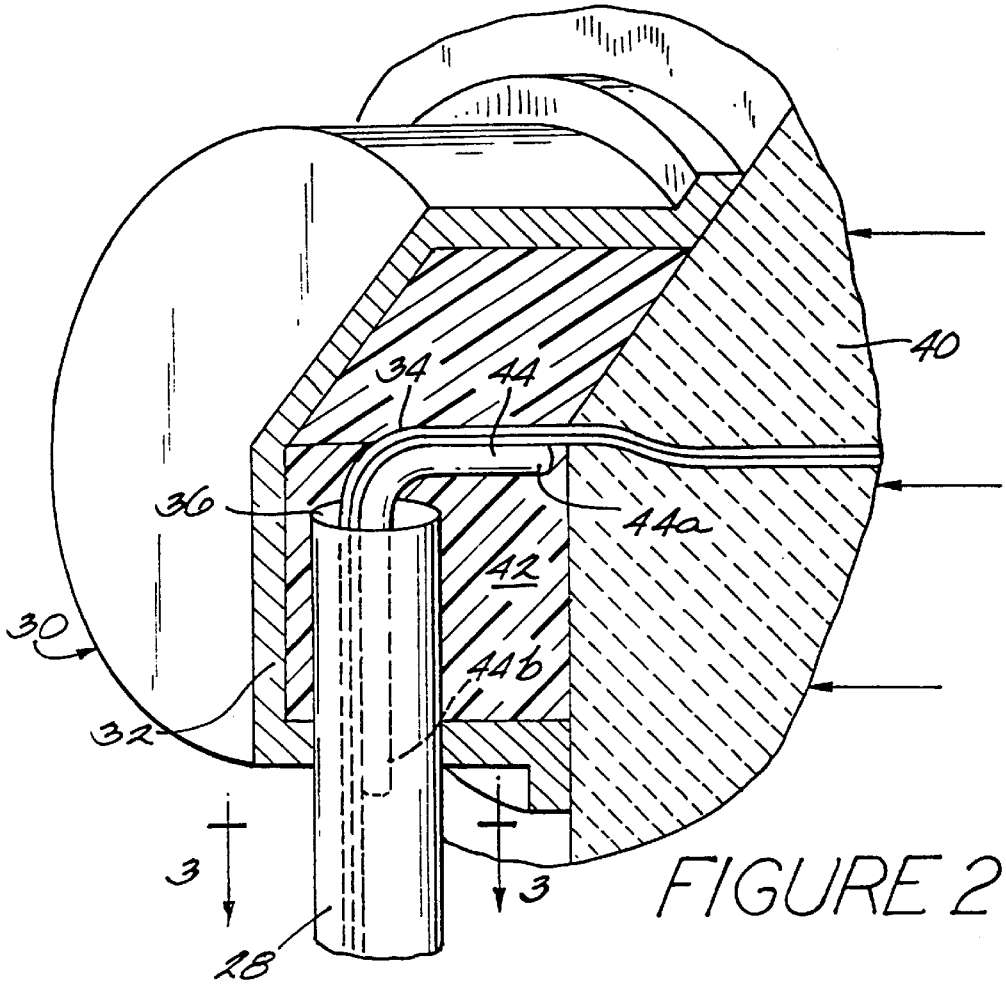
FIG. 2 is a partial sectional view showing the embodiment of FIG. 1 in greater detail.

Referring to FIG. 2, there is shown HV connector 30 provided with a housing 32, which is usefully formed of aluminum and is joined to tube housing 12, such as at an end thereof. FIG. 2 further shows HV cable 28 comprising electric conductor or conductors 34 positioned along the center of the cable, and a layer of HV insulation 36 surrounding conductors 34. As stated above, there may be a single solid conductor 34 or a number of conductors, as shown in FIG. 2. Conductors 34 usefully comprise copper, and insulator 36 usefully comprises a material such as EP rubber. Such material provides HV cable 28 with flexibility, and at the same time provides sufficient insulation for the high voltage electric power carried thereby.

Referring further to FIG. 2, there is shown cable 28 inserted into HV connector 30, through an aperture in connector housing 32. Conductors 34 extend beyond the end of insulation layer 36, and as shown by FIG. 1 are directed through tube housing 12 and mated with an electric coupling element 38, joined to cathode 14. Coupling element 38 and cathode 14 are supported in place by insulating structure 40, inserted into the end of tube 10 and formed of ceramic material or the like.

In order to insulate the exposed end portion of conductors 34, that is, the portion extending between the end of EPR insulator 36 and ceramic insert 40 within tube 10, FIG. 2 shows HV connector housing 32 filled with electrical insulating material such as epoxy 42. However, as is well known in the art, substantial amounts of heat are generated by operation of X-ray tube 10. Some of this heat is directed toward insert 40 and HV connector 30, as illustrated by the leftward-directed arrows of FIG. 2. While ceramic insert 40 is a comparatively good thermal conductor, the epoxy insulation 42 of connector 30 is a very poor thermal conductor. Accordingly, the epoxy 42 acts as a thermal barrier.

Figure 3:
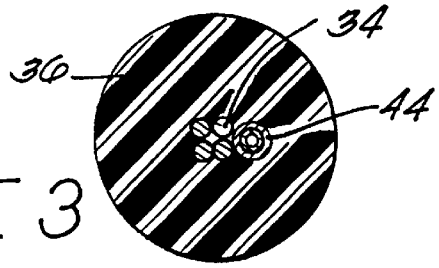
FIG. 3 is a sectional view taken along lines 3—3 of FIG. 2.

In order to dissipate heat projected toward connector 30 from within the tube 10, and to prevent such heat from raising the temperature of connector 30 to an unacceptable level, FIGS. 2 and 3 show an elongated heat transfer device 44 placed within cable 28 and connector 30. The heat transfer device 44 comprises a heat pipe or like device of extremely high thermal conductivity, as described hereinafter in further detail in connection with FIG. 4. FIGS. 2 and 3 show heat transfer device 44 positioned in closely spaced relationship with conductors 34, and extending along a portion of the length thereof. More particularly, FIG. 2 shows transfer device 44 having an end 44*a* positioned close to insert 40, and thus close to the heat received therethrough, and further shows the opposing end 44*b* of device 44 extending outward from connector housing 32. If a location along the transfer device 44 is at a different temperature than another location, the device 44 will operate to rapidly transfer heat from the location of higher temperature to the location of lower temperature. Thus, device 44 readily serves to transfer excessive heat from regions proximate to its end 44*a*, close to insert 40, to its opposing end 44*b*. Even though opposing end 44*b* is within insulating layer 36, it lies outside the epoxy layer 42 of connector 30, so that heat can readily be dissipated therefrom into housing 32, and radiated by the housing into the surrounding air. The transfer of heat by device 44 is passive. Thus, the heat transfer device 44 of connector 30 provides simple and effective cooling, while maintaining essential electrical characteristics required for the connector.

Figure 4:
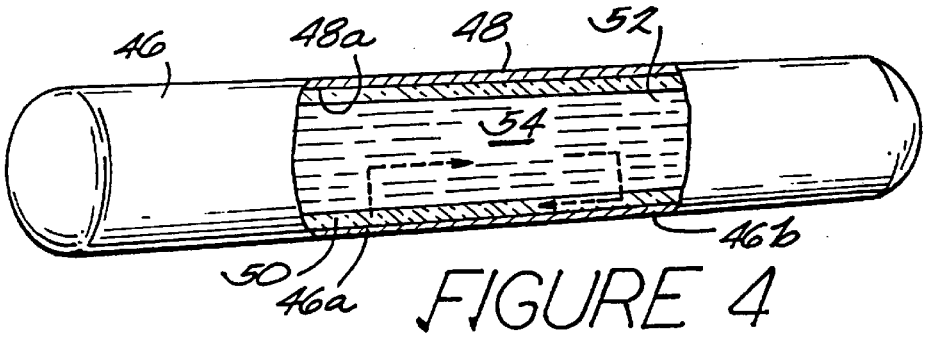
FIG. 4 is a perspective view showing a heat transfer device, with a section broken away, which may be adapted for the embodiment of FIG. 1.

To illustrate operation of a heat transfer device, FIG. 4 shows a heat transfer device 46 comprising a length of copper tubing or conduit, which is tightly closed or sealed at its ends to form a vacuum tight vessel. Device 46 is similar or identical to heat transfer device 44 of FIG. 2, except that device 44 is provided with an angled bend along its length whereas device 46 has a linear configuration. The vacuum tight vessel of heat transfer device 46 is evacuated and partially filled with a working fluid 52, such as water, and is usefully of circular cross section. FIG. 4 further shows a porous metal wicking structure 50, which is joined to the inner wall or surface 48*a* of copper conduit 48. Wicking structure 50 is usefully formed of a porous material, such as a material comprising small copper pellets or beads which are sintered together. Wick structure 50 is configured to surround or define a passage 54 which extends along the length of transfer device 46.

By providing a heat transfer device with the construction shown in FIG. 4, such device is enabled to transfer heat by respective evaporation and condensation of working fluid 52. More particularly, if point 46*a* along device 46 is at a higher temperature than a location 46*b* spaced apart therefrom, heat is inputted through conduit 48 into the interior thereof, proximate to location 46*a*. As a result, fluid 52 is vaporized in passage 54 proximate to location 46*a*. This creates a pressure gradient in passage 54, between a region proximate to location 46*a* and a cooler region proximate to location 46*b*. This pressure gradient forces the vaporized fluid to flow along passage 54 to the cooler region, where it condenses to a liquid and gives up its latent heat of vaporization. The working fluid 52, now in liquid form, then flows in the opposite direction along device 46, back toward location 46*a*, through the porous wick structure 50. Such fluid motion is caused by capillary action in the wick structure, or by gravity if device 46 is oriented to decline downwardly from location 46*b* to location 46*a*. Usefully, a heat transfer device 44 or 46 comprises a device which is similar to a product sold by Thermacore Inc. and referred to commercially thereby as a heat pipe. Devices of such type may have an effective thermal conductivity which exceeds the thermal conductivity of copper by more than $10^3$ times.

Figure 5:
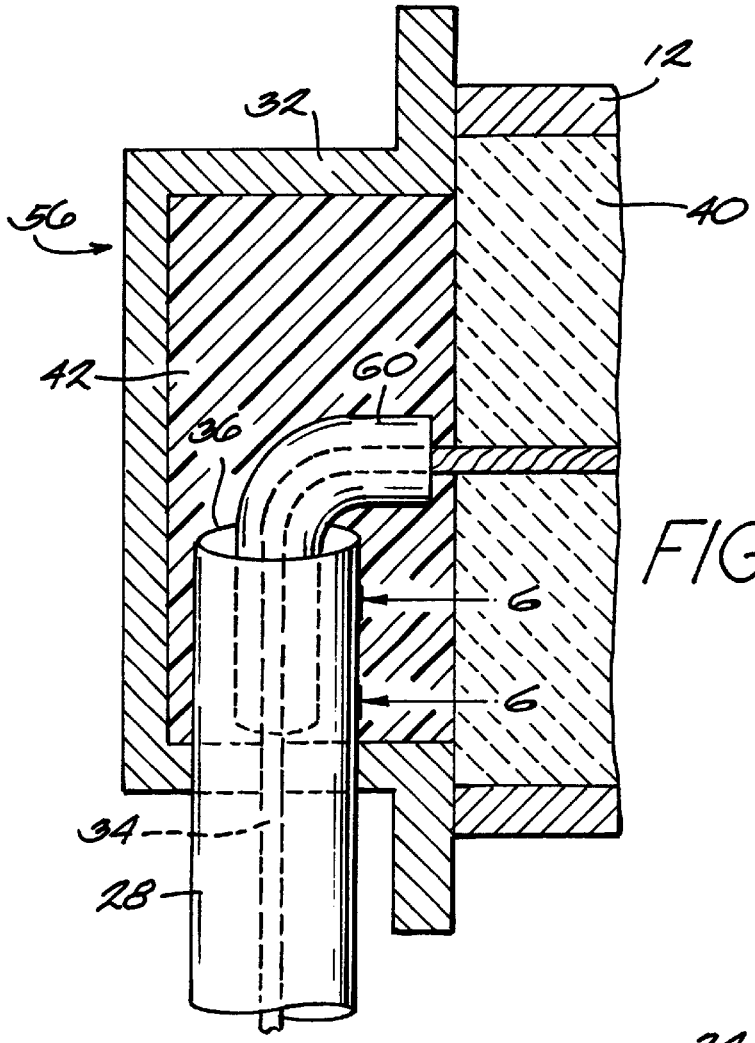
FIG. 5 is a partial sectional view showing a second embodiment of the invention.
Figure 6:
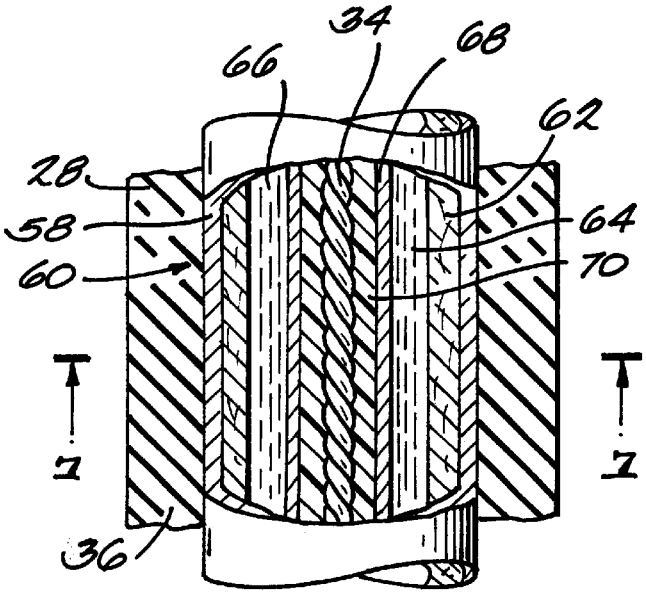
FIG. 6 is a partial sectional view taken along lines 6—6 of FIG. 5.
Figure 7:
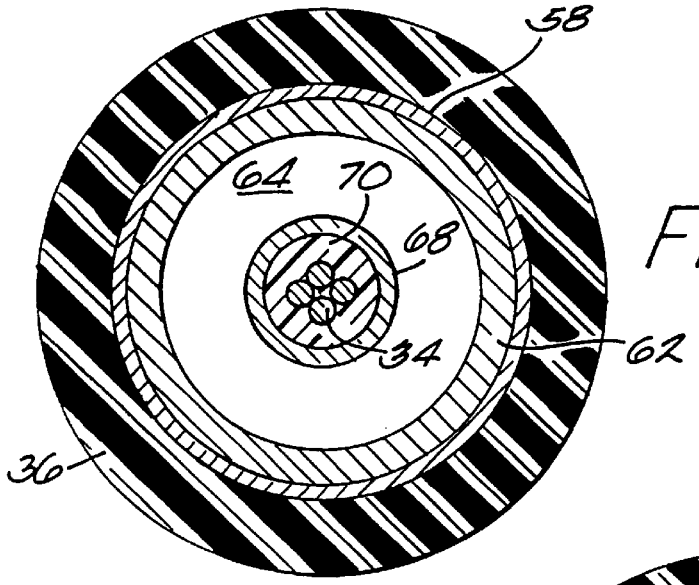
FIG. 7 is a sectional view taken along lines 7—7 of FIG. 6.

Referring to FIG. 5, there is shown an alternative embodiment of the invention, comprising an HV connector 56, which for reasons set forth hereinafter significantly reduces the electric field, in comparison with the previously described embodiment. The embodiment of FIG. 5 also enhances uniformity of the electric field, that is, causes the field to be less non-uniform. Connector 56, in like manner with connector 30, is provided with an aluminum housing 32 filled with a layer of epoxy 42, and cable 28 is passed through connector 56, from a location outside the connector into X-ray tube 10. Connector 56 is also provided with a heat transfer device 60 extending along a portion of the cable 28. As best shown by FIGS. 6 and 7, transfer device 60 comprises a sealed copper conduit 58 of circular cross-section and a porous wick structure 62 joined thereto, similar to conduit 48 and wick structure 50, respectively, of heat transfer device 46 described above. Wick structure 62 defines a passage 64 along transfer device 60 which contains water or other working fluid 66. However, the diameter of heat transfer device 60 is substantially greater than the diameter of transfer device 44, whereby device 60 can be positioned around cable conductors 34 rather than placed alongside them. More particularly, conduit 58 of device 60, as shown by FIGS. 6 and 7, is positioned in coaxial relationship with cable 28, so that cable conductors 34 extend through the center of conduit 58, proximate to the axis thereof.

Referring further to FIGS. 6 and 7, there is shown heat transfer device 60 provided with a cylindrical sleeve 68, formed of copper or the like, which extends along conduit 58 in coaxial relationship. Sleeve 68 is placed around conductors 34 in closely spaced relationship, and its ends (not shown) are seably joined to corresponding ends (not shown) of conduit 58. Accordingly, passage 64 through transfer device 60 comprises a sealed interior space which is separated from conductors 34 by the sleeve 68.

FIGS. 6 and 7 further show the space between conductors 34 and the inner surface of sleeve 68 filled with a material 70. In one embodiment, material 70 comprises metal powder filled epoxy or other conductive material. In such embodiment sleeve 68 and conduit 58 of heat transfer device 60 are electrically connected to the cable conductors 34, and are thus at the same voltage U, such as 100 KV. As is known by those of skill in the art, the electric field of a conductive cylinder is inversely proportional to the cylinder radius R. Accordingly, by electrically connecting conduit 58 to conductors 34, the electric field around transfer device 60 will be determined by the radius of conduit 58 rather than the radius of conductors 34. Since the radius of conduit 58 is substantially greater, the electric field will be significantly reduced. Moreover, the circular cross-section of conduit 58 provides a much more uniform E-field than the generally elliptical or irregular shaped cross-section of the cable conductors 34 and heat transfer device 44.

In an alternative embodiment, the material 70 shown in FIGS. 6 and 7 comprises an epoxy which principally serves as an insulator, but is also selected to have a conductivity which is slightly greater than the conductivity of insulation layer 36 surrounding heat transfer device 60, as shown in FIGS. 5 and 6. As a result, there will be a first voltage potential between cable conductors 34 and conduit 58 of device 60, and a second voltage potential between conduit 58 and the outer surface of insulating layer 36. For example, by judicious selection of the conductivity of material 70, the first voltage potential could be on the order of 20 KV, and the second voltage potential could be on the order of 80 KV. Such configuration provides a graded insulating system, from conductors 34 through device 60 to the outer edge of insulating layer 36, to optimize the overall electric field distribution inside connector 56.

Referring further to FIG. 5, there is shown an end of heat transfer device 60 proximate to aluminum housing 32, rather than extending outward therethrough. This arrangement enables device 60 to readily transfer heat from the interior of connector 56 to connector housing 32, which effectively dissipates heat into the surrounding air. Proper termination of the end, and maintenance of a sufficient high voltage clearance between the end of device 60 and housing 32, are necessary to provide an acceptable design margin. In another arrangement, the bend or elbow in device 60 may be eliminated.

Figure 8:
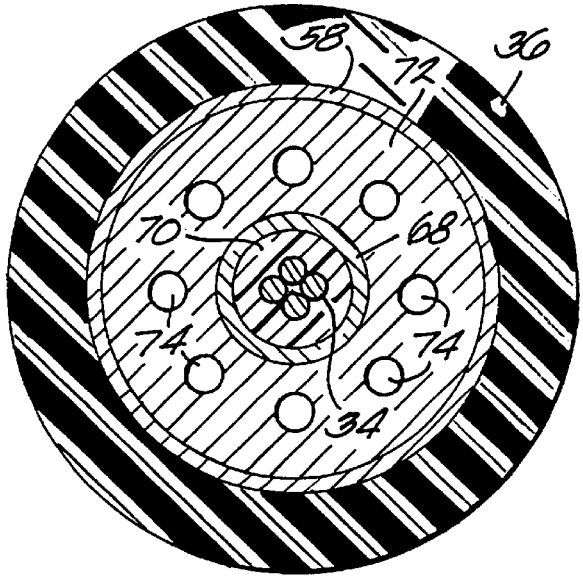
FIG. 8 is a sectional view showing a modification of the embodiment shown in FIG. 5.

Referring to FIG. 8, there is shown an alternative construction for heat transfer device 60. Instead of a wick structure 62 surrounding a passage 64, a wick structure 72 is provided which extends from conduit 58 to sleeve 68. A number of passages 74 are formed through the wick structure, equally spaced around the sleeve 68, to carry vaporized working fluid as described above.

Figure 9:
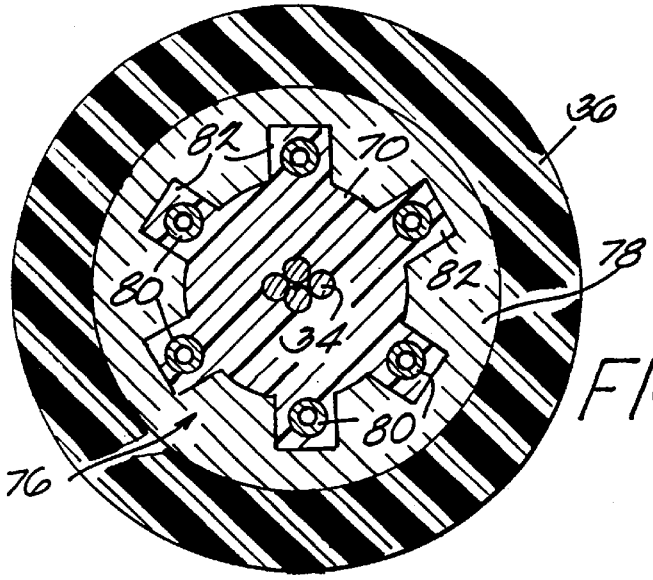
FIG. 9 is a sectional view showing a third embodiment of the invention.

Referring to FIG. 9, there is shown a heat transfer arrangement 76, which may be used in connector 56 instead of the heat transfer device 60 described above. Transfer arrangement 76 comprises a sleeve 78, formed of copper or other conductive material, which is positioned around and extends along the conductors 34 within connector 56, in coaxial relationship therewith. A number of heat transfer devices 80, each similar to transfer device 44, are equally spaced around the inner surface of sleeve 78. While not shown, each of the transfer devices 80 is bended or angled as necessary to extend along sleeve 78, in generally parallel relationship with the axis thereof. FIG. 9 further shows notches 82 formed in sleeve 78, to accommodate respective transfer devices 80. By placing the transfer devices 80 around conductors 34 in the symmetrical arrangement shown in FIG. 9, desirable electric field effects are achieved, similar to those described above in connection with transfer device 60. However, the configuration of FIG. 9 should have significantly less cost. Referring further to FIG. 9, there is shown the space between conductors 34 and sleeve 78 filled with material 70 as described above.

Obviously, many other modifications and variations of the present invention are possible in light of the above teachings. It is therefore to be understood that within the scope of the disclosed concept, the invention may be practiced otherwise than as has been specifically described.

What is claimed is:

1. Apparatus for connecting an HV electric cable to an X-ray tube, said cable being provided with one or more conductors and said apparatus comprising;

a housing disposed for attachment to said X-ray tube;

a quantity of selected electric insulating material contained within said housing and defining a boundary between regions within said tube and said housing, respectively, said insulating material being traversed by a portion of said HV cable;

an elongated heat transfer device positioned in said insulating material to extend along at least part of said traversing portion of said cable;

a quantity of selected working fluid sealably contained in said heat transfer device, said working fluid disposed for bi-directional movement along said device to transfer heat from a first location within said insulating material to a second location therein which is closer to said housing; and said heat transfer device having a first end located proximate to said boundary, said first end being sealed to prevent said working fluid from passing through said first end.

2. The apparatus of claim 1, wherein said heat transfer device comprises:

a conduit segment of selected length, said conduit segment having an inner wall in adjacent relationship with a sealed interior space; and selected porous material attached to said inner wall and configured to define a passage through said sealed interior space that extends along the length of said conduit segment, said porous material being selected in relation to said working fluid so that said fluid, when in liquid form, is disposed for movement through said porous material by means of capillary action.

3. The apparatus of claim 2 wherein:

when said first location is at a selectively higher temperature than said second location, fluid proximate to said first location is vaporized into gaseous form, moved along said passage by means of convection to said second location, and then condensed into liquid form.

4. The apparatus of claim 3 wherein:

said conduit segment is positioned with respect to said cable so that said one or more conductors of said cable extend along the center of said conduit segment, proximate to the axis thereof.

5. The apparatus of claim 4 wherein:

said conduit segment comprises a selected electrically conductive material; and a sleeve of selected electrically conductive material is positioned within said conduit segment, in coaxial relationship therewith, between said sealed interior space and said one or more conductors of said cable.

6. The apparatus of claim 3 wherein:

said apparatus includes a sleeve of selected electrically conductive material placed around said one or more conductors of said cable; and said conduit segment comprises one of a plurality of substantially identical conduit segments which are equally spaced around the inner surface of said sleeve.

7. The apparatus of claim 3 wherein:

said housing is formed of a metal disposed to radiate and convect thermal energy to the environment; and an end of said conduit segment is placed in proximate relationship with said housing.

8. The apparatus of claim 7 wherein said HV cable is disposed to carry electric power on the order of 100 kilovolts, and wherein:

said insulating material comprises epoxy.

9. The apparatus of claim 7 wherein:

said housing comprises aluminum.

10. The apparatus of claim 7 wherein:

said working fluid comprises water.

11. Apparatus for connecting an HV electric cable provided with one or more conductors to an X-ray tube comprising:

a connector housing attached to said X-ray tube and disposed to receive a segment of said cable;

electric insulating material contained within said housing and placed around said cable segment;

a heat transfer device comprising a conduit segment extending along said cable segment within said connector housing; and a quantity of selected working fluid sealably contained in said conduit segment, said working fluid, when the temperature at a first position along said given conduit segment is selectively higher than the temperature at a second position therealong, being disposed to flow in gaseous form from said first position to said second position, and to flow in liquid form from said second position to said first position, said fluid flow resulting in the transfer of heat along said conduit from said first position to said second position.

12. The apparatus of claim 11 wherein:

said conduit segment has an inner wall in adjacent relationship with a sealed interior space; and selected porous material is attached to said inner wall and configured to define a passage through said sealed interior space that extends along the length of said conduit segment, said porous material being selected in relation to said working fluid so that said fluid, when in liquid form, is disposed for movement through said porous material by means of capillary action.

13. The apparatus of claim 12 wherein:

when said first location is at a selectively higher temperature than said second location, fluid proximate to said first location is vaporized into gaseous form, moved along said passage by means of convection to said second location, and then condensed into liquid form.

14. The apparatus of claim 13 wherein:

said apparatus includes a sleeve of selected electrically conductive material placed around said one or more conductors of said cable; and said conduit segment comprises one of a plurality of substantially identical conduit segments which are equally spaced around the inner surface of said sleeve.

15. The apparatus of claim 14 wherein;

said HV cable is disposed to carry electric power at a potential of 150 kilovolts, and said insulating material comprises epoxy.

16. The apparatus of claim 13 wherein:

said conduit segment is positioned with respect to said cable so that said one or more conductors of said cable extend along the center of said conduit segment, proximate to the axis thereof.

17. The apparatus of claim 16 wherein:

said conduit segment is formed of electrically conductive material; and a sleeve of selected electrically conductive material is positioned within said conduit segment, in coaxial relationship therewith, between said sealed interior space and said one or more conductors of said cable, said sleeve being electrically connected to said conduit segment.

18. The apparatus of claim 17 wherein:

a space between said conductive sleeve and said one or more conductors is filled with an electrically conductive material.

19. The apparatus of claim 17 wherein:

a space between said conductive sleeve and said one or more conductors is filled with an electrically insulating material having an electrical conductivity which is slightly greater than the electrical conductivity of said insulating material placed around said cable segment.

20. The apparatus of claim 17 wherein said porous material extends from said conduit segment to said sleeve within said sealed interior space; and said passage comprises one of a plurality of passages formed through said porous material and positioned around said sleeve in equidistant relationship.

* * * * *